US005419491A

United States Patent [19]

Breitsprecher

[11] Patent Number: 5,419,491

[45] Date of Patent: May 30, 1995

[54] TWO COMPONENT FLUID SPRAY GUN AND METHOD

[75] Inventor: Charles O. Breitsprecher, Plymouth, Minn.

[73] Assignee: Mattson Spray Equipment, Inc., Rice Lake, Wis.

[21] Appl. No.: 247,575

[22] Filed: May 23, 1994

[51] Int. Cl.[6] ..... B05B 7/08

[52] U.S. Cl. ..... 239/9; 239/294; 239/296; 239/419.3; 239/428; 239/527

[58] Field of Search ..... 239/9, 10, 290, 294, 239/419.3, 433, 296, 428, 527

[56] References Cited

U.S. PATENT DOCUMENTS

| | | | |
|---|---|---|---|
| 2,335,116 | 11/1943 | Hansen . | |
| 2,739,843 | 3/1956 | Baur | 239/428 |
| 2,829,006 | 4/1958 | Johansson | 239/294 |
| 4,187,983 | 2/1980 | Boyer | 239/9 |
| 4,760,956 | 8/1988 | Mansfield | 239/419.3 |
| 4,817,872 | 4/1989 | Mattson | 239/300 |
| 4,824,017 | 4/1989 | Mansfield | 239/9 |
| 4,854,504 | 8/1989 | Hedger, Jr. et al. | 239/419.3 |
| 4,927,079 | 5/1990 | Smith | 239/300 |
| 4,967,956 | 11/1990 | Mansfield | 239/419.3 |
| 5,080,283 | 1/1992 | Kukesh et al. | 239/419.3 |
| 5,170,941 | 12/1992 | Norita et al. | 239/601 |
| 5,303,865 | 4/1994 | Bert | 239/9 |
| 5,307,992 | 5/1994 | Hall et al. | 239/296 |

*Primary Examiner*—Andres Kashnikow
*Assistant Examiner*—Christopher G. Trainor
*Attorney, Agent, or Firm*—Jacobson and Johnson

[57] ABSTRACT

An air-operated fluid spray gun for mixing multiple fluids together almost simultaneously with depositing the mixture on a surface by directing an atomized stream of one fluid out the end of the gun barrel toward the surface and injecting an atomized stream of another fluid generally radially into the first stream so that the streams mix thoroughly and the mixture is almost simultaneously deposited on the surface.

9 Claims, 2 Drawing Sheets

TWO COMPONENT FLUID SPRAY GUN AND METHOD

FIELD OF THE INVENTION

This invention is directed toward pneumatic spray guns for fluids in which pressurized air is used to atomize the stream of fluid ejected out the open end of the barrel of the gun with an air cap at the open end of the gun having fanning air ports or nozzles for directing air toward the atomized stream to form the stream into a fan shape for applying the fluid to a surface to be coated. In particular the invention is directed toward applying an atomized stream of another fluid from the fanning air nozzles to mix with the first stream just prior to or as the material deposits on the surface.

Description of the Prior Art

U.S. Pat. No. 4,927,079 by Smith and U.S. Pat. No. 2,335,116 by Hansen are illustrative of the prior art. In general both of these patents describe a device and system whereby two liquid components which are to be mixed together are carded through passageways down the barrel of a pneumatic spray gun and pressurized air is emitted out orifices surrounding the stream of liquid to atomize the liquids. The atomized streams are directed to come together close to the end of the barrel. The resulting mixture then travels to the surface of the article that is to be coated. Both of these patents also illustrate an air cap at the end of the gun barrel having fanning air orifices or nozzles for pressurized air to be applied generally radially to the stream of mixed atomized liquids to form it into a fan shape for more convenient application to the surface to be coated.

Another prior art device which relates only to a single component liquid, such as paint, is illustrated in U.S. Pat. No. 4,817,872 by Mattson which utilizes a liquid being ejected out a passageway at the end of the barrel of a gun and an orifice of pressurized air around the liquid to form it into an atomized spray and which includes pressurized fanning air applied generally radially to the atomized spray from nozzles or orifices in an air cap to form the spray into a fan shape if so desired.

This manner of mixing and applying plural liquid components has some drawbacks when used to apply an adhesive to a surface where one of the liquid components is the adhesive and the other is a catalyst or activator and the two must be almost simultaneously mixed together and deposited on the surface. Typically materials of this nature are identified as materials supplied by 3-M Company Adhesive Systems of St. Paul, Minn. and known by the name "FAST BOND" (trademark) 2000-NF Adhesive which is mixed with Fast Bond Spray Activator which produces a water-dispersed high solids activated adhesive which provides immediate bonding capabilities and handling strength without forced drying equipment. A technical bulletin published by 3-M dated September, 1993 provides detailed specifications for these materials. The technical bulletin explains that air atomizing spray equipment should preferably be used with separate fluid nozzles being used for the activator and the adhesive with the mixing taking place outside the applicator. The publication goes on to explain that a ratio of about 10 parts of the adhesive to 1 part activator by weight or volume should be used. It has been found that the adhesive is unusable unless the mixing occurs almost simultaneously with the mixture being deposited on the surface to be coated.

The prior art devices described above and operated in the fashion described above are not directed toward forming the mixture and depositing it at the same time and so are inefficient in dealing with the adhesive product described above. Even more importantly in the prior art two-component guns the atomized liquids come together very close to the liquid ejection ports where the adhesive is activated and deposits on the gun barrel at the ports which stops up or seriously impedes the flow of liquid and air out the ejection ports at the end of the barrel.

SUMMARY OF THE INVENTION

The present invention utilizes a system quite similar to that illustrated in the Mattson '872 patent. A two component liquid mixture is formed by a first liquid component being in a chamber in the gun barrel and ejected out the end of the gun barrel with pressurized air exiting by an orifice surrounding the liquid stream to atomize it as it leaves the gun barrel. Pressurized air is also carded by passageways to the air cap fanning nozzles which also receive another liquid component so that the other liquid is atomized and ejected out the fanning ports or nozzles of the air cap generally radially into the stream of the first mentioned atomized liquid coming out the end of the barrel. The two atomizer streams of liquid join and are mixed together virtually at the surface upon which the coating is being applied. In particular, the fluid that is ejected out the end of the barrel is a liquid adhesive of the nature described above and the atomized fluid ejected generally radially into the first stream of fluid is a catalyst or activator as described above so that the two are mixed together in a fashion and at a location such that the mixture is then almost instantaneously deposited on the surface as desired. In this fashion, the mixing occurs some substantial distance from the end of the barrel of the gun so the adhesive will not set and deposit on the gun barrel to interfere with the ejection of the atomized stream of liquid or air out the end of the gun barrel.

DESCRIPTION OF THE PREFERRED EMBODIMENTS

Figure 1:
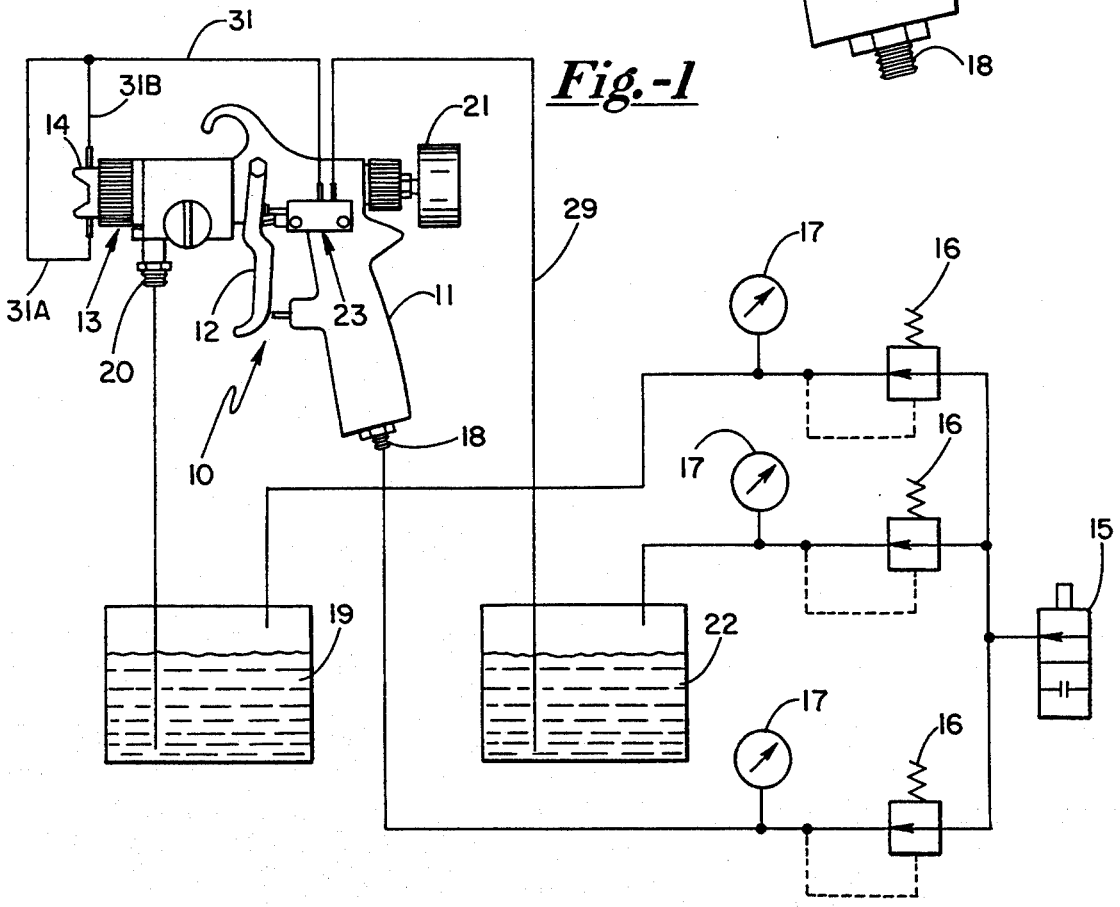
FIG. 1 is a functional illustration of the operation of the invention.

FIG. 1 illustrates the invention utilizing a generally conventional hand operated fluid spray gun which is identified generally by reference numeral 10. It has a hand-held handle 11, a finger-operated trigger 12, a barrel generally identified by reference numeral 13 and an air cap 14 attached to the exit end of the barrel. Pressurized air from a suitable source identified by reference numeral 15 controlled by suitable regulators 16 and usually monitored by suitable meter 17 is fed into the end of handle 11 at fitting 18 and fluid such as a liquid adhesive identified by reference numeral 19 from a suitable container or suitable source is fed radially into the gun barrel through a fitting 20. A suitable pressure meter 21 may be mounted on gun 10 to give a visual indication of the air pressure as the gun is operated. The conventional gun as described hereinabove is modified according to the teachings of the instant invention by feeding another fluid such as an activator or catalyst liquid identified by reference numeral 22, from a suitable container or source through a valve identified by reference numeral 23 to the air cap 14. Conventionally, pressurized air from source 15 is fed to the containers for liquids 19 and 22 to provide pressurization for the respective containers.

Figure 2:
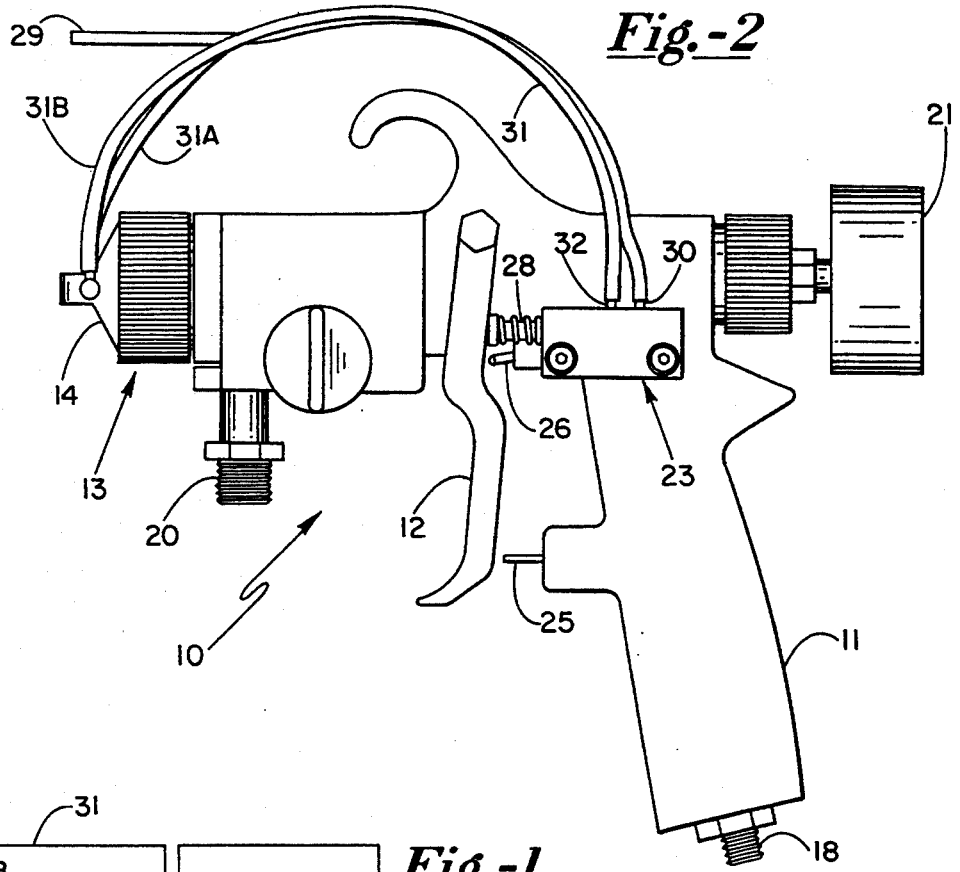
FIG. 2 is a profile of an air-operated fluid spray gun constructed to function in a manner according to the teachings of the invention.
Figure 3:
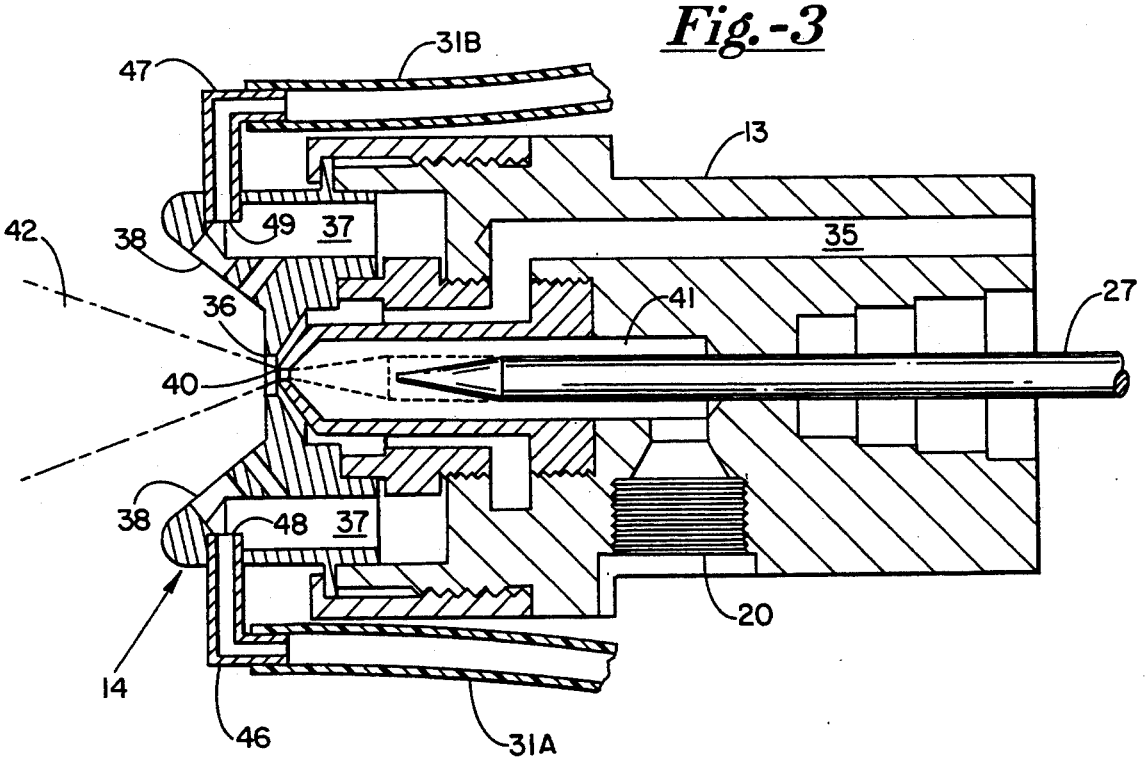
FIG. 3 is a sectioned view of the end of the barrel of a spray gun constructed to operate according to the teachings of the invention.

Turning to FIG. 2, in a conventional fashion trigger 12 is operated to first move plunger 25 to open a valve, not shown, in handle 11 so that the pressurized air is present before any fluid or liquid. This is followed by trigger 12 actuating a spring-loaded plunger 28 of valve 23. Fluid 22 is carried by a suitable conduit such as tube or hose 29 to an inlet port 30 of valve 23. Another suitable conduit such as hose or tube 31 is attached to the outlet port 32 of valve 23 to carry fluid 22 to air cap 14. In the preferred embodiment tube 31 is separated into two parts, 31A and 31B, which are respectively attached to fittings 46 and 47 for respective activator fluid nozzles 48 and 49 in air cap 14 which are located diametrically opposite one another at about the axis or center of the gun barrel. Trigger 12 then actuates plunger 26 which in turn is linked internally (not shown) in a convenient fashion to a conventional elongated needle-nosed plunger or rod 27 (FIG. 3) which, conventionally, is slidably mounted along the axis or center of gun barrel 13. This controls the flow of fluid 19 out the fluid exit port 40.

Figure 4:
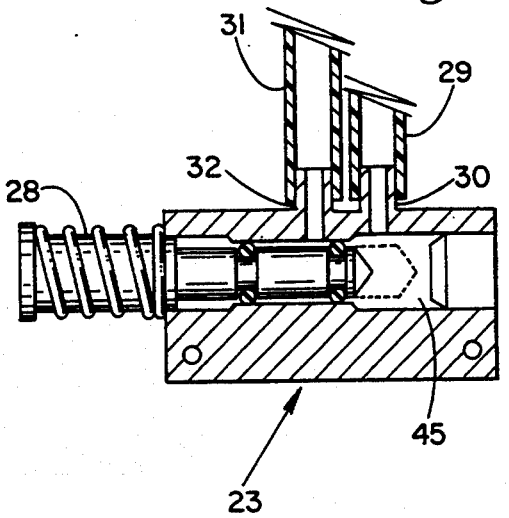
FIG. 4 is a sectioned view of a valve used for selectively feeding one of the fluids used in a preferred embodiment of the invention.

Typically the system operates in the following manner or fashion. Utilizing a hand-held pneumatically operated spray gun such as illustrated and identified by reference numeral 10 with hose or tube 29 coupled to the source of liquid catalyst or adhesive activator 22 and liquid adhesive 19 being fed by an appropriate tube or hose to fitting 20 and regulated pressurized air coming from air source 15 coupled to fitting 18 in the handle 11 of gun 10, in conventional fashion trigger 12 is operated to first move plunger 25 so that the pressurized air is fed down the barrel 13 of gun 10 via passageway 35 so that the pressurized air appears at the air outlet orifice 36 at the open end of the gun barrel. At the same time pressurized air also travels down the barrel of the gun through another passageway, not shown, to air chamber 37 and from there out fanning air ports or nozzles 38 located in air cap 14. As the trigger 12 is advanced further it operates spring-loaded plunger 28 of valve 23. As plunger 28 moves rearward or rightward, as observed in FIGS. 2 and 4, the catalyst or activator fluid 22 which enters valve chamber 45 via hose 29 is allowed to leave via exit port 32 and hose 31 and is carried by the split hoses 31A and 31B to suitable fittings 46 and 47 which are attached to respective nozzles 48 and 49 in fanning air chamber 37. Activator fluid nozzles 48 and 49 are located very close to fan air nozzles or outlet ports 38 and are sized and directed so that the fluid from nozzles 48 and 49 exits from ports 38 atomized by the pressurized air in chamber 37 without striking any part of air cap or chamber 37. The pressurized air in chamber 37 atomizes the catalyst or activator fluid 22 so it is ejected out fanning nozzles 38 as a spray directed generally radially toward and into spray 42 of adhesive fluid. In this fashion the two fluids are mixed together very thoroughly at virtually the same time that the mixture is deposited upon the surface to be coated, which is not shown but which conventionally is located just beyond the end of air cap 14.

Spray 42 is formed by trigger 12 operating plunger 26 which is linked mechanically in some conventional fashion, not shown, to elongated needlenosed rod or plunger 27. The latter normally is biased by a spring, not shown, to be in the position shown by dashed lines in FIG. 3 closing off the fluid exit or outlet port 40 from fluid chamber 41. The liquid adhesive which enters fluid chamber 41 via fitting 20 fills chamber 41 but remains within the chamber as long as rod 27 is in the closed position. When trigger 12 is operated so that rod 27 is withdrawn from the closed position, as illustrated by the solid lines, fluid adhesive 19 is ejected in a stream out fluid outlet port 40 and is atomized into fine droplets by the pressurized air from orifice 36 to produce a stream 42 of fine droplets of adhesive fluid. In the general case fluid and air exit ports 40 and 36 are circular and the stream 42 comes out cone-shaped. The pressurized air being ejected out of fanning air ejection ports 38 which are located diametrically opposite one another in air cap 14 tend to form the cone-shaped spray into a generally fan-shaped spray which has been found convenient for applying the material to a surface to be coated.

As mentioned earlier the nature of the materials being mixed to form the adhesive are such that the mixture must be made almost simultaneously with the mixture being deposited on the surface to be coated otherwise the material does not have the characteristics that are necessary to serve its purposes. The mixture of the two atomized liquids occurs far enough away from the liquid and air outlet ports 36 and 40 at the end of the gun barrel so that there is little or no likelihood that any of the mixed material deposits on the gun barrel to interfere with the ejection of fluid or air from the gun barrel. At the same time, it takes place at a location close enough to the end of the gun barrel so that it is deposited almost immediately on the surface of the article that is being coated.

Also, as mentioned earlier, the nature of the materials are such that it is recommended that the ratio of adhesive liquid 19 to the catalyst liquid 22 is in the range of about 10 parts to 1 by volume or weight.

Although the invention is described in conjunction with a hand-held spray gun using a finger-operated trigger it should be understood that other mechanical forms can be utilized to put the invention into practice. For example, mechanically operated sprayers using mechanical or electrical devices for controlling or triggering the flow of air and fluids can be used and come within the teachings of this invention.

I claim:

1. A method for spraying a mixture of two fluids onto a surface to be coated using an air-operated spray gun having a barrel, said method comprising the steps of:

a) ejecting an atomized stream of a first fluid axially out the end of the barrel of the air-operated spray gun directed toward a surface to be coated;

b) ejecting a Stream of a second fluid out of said spray gun;

c) atomizing said second fluid just as it is ejected from the spray gun: and d) directing the atomized stream of said second fluid generally radially into the atomized stream of said first fluid so that it thoroughly mixes with the first fluid stream almost simultaneously with depositing the mixture on the surface to be coated.

2. The method as described in claim 1 wherein said second fluid stream is directed from opposite sides generally radially into said first fluid stream.

3. In a fluid spray gun having a barrel with a fluid outlet opening surrounded by an atomizing air orifice located at the end of the gun barrel for ejecting an atomized fluid stream axially out the gun barrel to a surface to be coated and having an air cap attached to the end of the gun barrel, said air cap having air nozzles for directing pressurized air generally radially toward the atomized fluid stream emitted from the end of the gun barrel, a method for producing a two component mixture for coating a surface, comprising the steps of:

a) ejecting an atomized stream of a first fluid component axially out the end of the barrel of the spray gun toward a surface to be coated;

b) ejecting streams of a second fluid out the air cap nozzles;

c) atomizing the streams of said second fluid just as they leave said nozzles with the pressurized air at said nozzles so that the atomized streams of said second fluid are directed generally radially into said atomized first fluid stream for mixing with the atomized first fluid stream just prior to the mixture being deposited on a surface.

4. The method as described in claims 1 or 3 wherein said first fluid is a liquid adhesive and said another fluid is a liquid activator for said adhesive.

5. The method as described in claim 3 wherein said first fluid is an adhesive and said another fluid is an activator for said adhesive and the ratio of said first fluid to said activator fluid is in the order of about ten to one.

6. In a fluid spray gun having a barrel with a fluid outlet opening surrounded by an atomizing air orifice located at the end of the gun barrel for forming an atomized fluid stream ejected axially out the end of the gun barrel directed to a surface to be coated and also having an air cap attached to the end of the gun barrel, said air cap having fanning nozzles for directing pressurized air generally radially into the fluid stream emitted from the end of the gun barrel, the improvement comprising:

means for feeding streams of a second fluid into said fanning nozzles so that the pressurized air in said fanning nozzles atomizes the second fluid streams and direct the atomized second fluid streams from said fanning nozzles generally radially into the atomized first fluid stream to mix with said atomized first fluid stream at about the surface to be coated.

7. The invention as described in claim 6 wherein said means for feeding streams of a second fluid to said fanning nozzles comprises:

a) a conduit outside the spray gun coupled to a source of said second fluid;

b) fittings inserted into said fanning nozzles, said fittings coupled to said conduit; and c) a valve located between said conduit and said source of second fluid for controlling the flow of said second fluid from the fluid source to said fittings.

8. In a fluid spray gun having a barrel with a fluid outlet opening surrounded by an atomizing air orifice located at the end of the gun barrel for forming an atomized stream of fluid ejected axially out the end of the gun barrel directed to a surface to be coated and also having an air cap attached to the end of the gun barrel, said air cap having fanning air nozzles for directing pressurized air generally radially at the fluid stream emitted from the end of the gun barrel, the improvement comprising:

fluid nozzles mounted in said air cap fanning air nozzles, said fluid nozzles having a fluid input for receiving fluid and an output for ejecting fluid, said fluid nozzle outputs located in close proximity to and in line with the air cap air nozzles so that the pressurized air in said fanning air nozzles atomizes the fluid from said fluid nozzles just as it is ejected to form an atomized fluid stream directed generally radially toward and to mix with the atomized fluid stream from the gun barrel.

9. The invention as described in claim 8, further including:

conduit means coupled to a source of fluid and valve means located in said conduit means for selectively controlling the flow of fluid to said air cap fluid nozzles.

* * * * *